United States Patent [19]

Drechsel

[11] Patent Number: 4,747,177

[45] Date of Patent: May 31, 1988

[54] CHIMNEY SWEEP SYSTEM

[75] Inventor: Lowell Drechsel, Erhard, Minn.

[73] Assignees: Delayne Drechsel; Randy Drechsel; William Lacey Peasley, all of Minneapolis, Minn.; a part interest to each

[21] Appl. No.: 889,175

[22] Filed: Jul. 25, 1986

[51] Int. Cl.[4] ..... F23J 3/00

[52] U.S. Cl. ..... 15/243; 15/249

[58] Field of Search ..... 15/163, 242, 243, 249

[56] References Cited

U.S. PATENT DOCUMENTS

| | | | |
|---|---|---|---|
| 344,460 | 6/1886 | Rowlett et al. | 15/243 |
| 423,268 | 5/1890 | Osgood | 15/243 |
| 1,543,018 | 4/1924 | Le Feuvre | 15/243 |
| 2,157,493 | 5/1939 | Miller et al. | 15/243 |
| 2,799,885 | 7/1957 | Puett | 15/243 |
| 4,028,769 | 6/1977 | Coviello et al. | 15/243 |
| 4,085,477 | 4/1978 | Anderson | 15/243 |
| 4,138,758 | 2/1979 | Dodge et al. | 15/243 |
| 4,261,073 | 4/1981 | Lane | 15/243 |
| 4,409,703 | 10/1983 | Marcellus | 15/243 |
| 4,538,317 | 9/1985 | Sorenson | 15/163 |

*Primary Examiner*—Harvey C. Hornsby
*Assistant Examiner*—Corinne M. Reinckens
*Attorney, Agent, or Firm*—Hugh D. Jaeger

[57] ABSTRACT

A chimney sweep system including a chimney support assembly, a winch attached to the chimney support assembly, and a scraper assembly connected to a cable of the winch which is used to lower and raise the scraper assembly within the chimney. The chimney support assembly is adjustable to accommodate different chimney lengths and widths. A scraper assembly includes upwardly concave bent edges, a flexing parallelogram which connects the scrapers to facilitate the descent of the scraper assembly into a chimney, and an elasticized collection bag for retention of scrapped creosote and dust.

1 Claim, 4 Drawing Sheets

CHIMNEY SWEEP SYSTEM

BACKGROUND OF THE INVENTION

1. Field of Invention

The present invention generally relates to chimney cleaning and, more particularly, pertains to a chimney sweep system which includes a mechanically raised and lowered scraper assembly with two independently adjustable solid scrapers connected by a flexing parallelogram.

2. Description of Prior Art

Traditionally, chimneys have been cleaned manually pulling a brush attached to the end of a long rod or pole upward and downward through the chimney. The removed creosote and dust falls to the bottom of the chimney where is is removed at the completion of cleaning. As each chimney brush fits only one size of chimney, a variety of sizes of brushes must be available to a chimney sweep.

In general, the prior art chimney cleaners have been large, complex, and messy mechanical devices requiring pulleys, reels, bracket members, or bases located on both the top and bottom of the chimney. The prior art chimney cleaners have also generally utilized brushes or lateral fingers of fixed size thereby limiting their application to a single chimney dimension.

These systems, or variations of them, contain serious drawbacks. One major drawback is that in general their size and complexity precludes easy portability. Another drawback is the lack of an adjustable cleaning assembly for use on chimney flues of various sizes and thus the commitment necessity of maintaining a number of variously sized cleaning assemblies. An additional drawback is the absence of adjustability for the accommodation of various chimney widths. Finally, none of these systems provide for collection of the removed creosote and dust.

The present invention overcomes the disadvantages of the prior art by providing a portable and adjustable chimney sweep system of reduced size and complexity, including an elasticized collection bag which retains scraped and removed debris, and which is adjustable to accommodate any size chimney and/or chimney flue.

SUMMARY OF THE INVENTION

The general purpose of the present invention is to provide a chimney cleaning system which adjusts to accommodate different internal and external chimney dimensions, and which contains an elasticized collection bag for scraped creosote and dust.

According to one embodiment of the present invention, there is provided a chimney sweep system including a scraper assembly, containing two separate and individually adjustable four sided scrapers, which is lowered and raised within the chimney by a winch, such as is commonly found on boat trailers and the like. The winch is mounted upon an adjustable support frame attached to the uppermost part of the chimney. A flexing parallelogram with pivoting arms allows the scraper assembly to contract to facilitate the descent of the scraper assembly and when the scraper assembly is raised, the parallelogram expands and is held into proper position by a limit chain. The scraper edges are solid and unyielding, unlike the brushes contained in the prior art, and a collection bag retains the scraped debris.

One significant aspect and feature of the present invention is a chimney sweep system which is portable, and can be either permanently or temporarily attached to the chimney.

An additional significant aspect and feature of the present invention is a chimney sweep system which provides individually adjustable scrapers to accommodate different internal chimney dimensions and configurations.

A further significant aspect and feature of the present invention is a chimney sweep system with solid and unyielding scrapers and not utilizing brushes, thereby producing improved cleaning action.

Another significant aspect and feature of the present invention is a chimney cleaning sweep system containing a collection bag for retention of removed creosote and dust.

BRIEF DESCRIPTION OF THE DRAWINGS

Other objects and many of the attendant advantages of the present invention will be readily understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
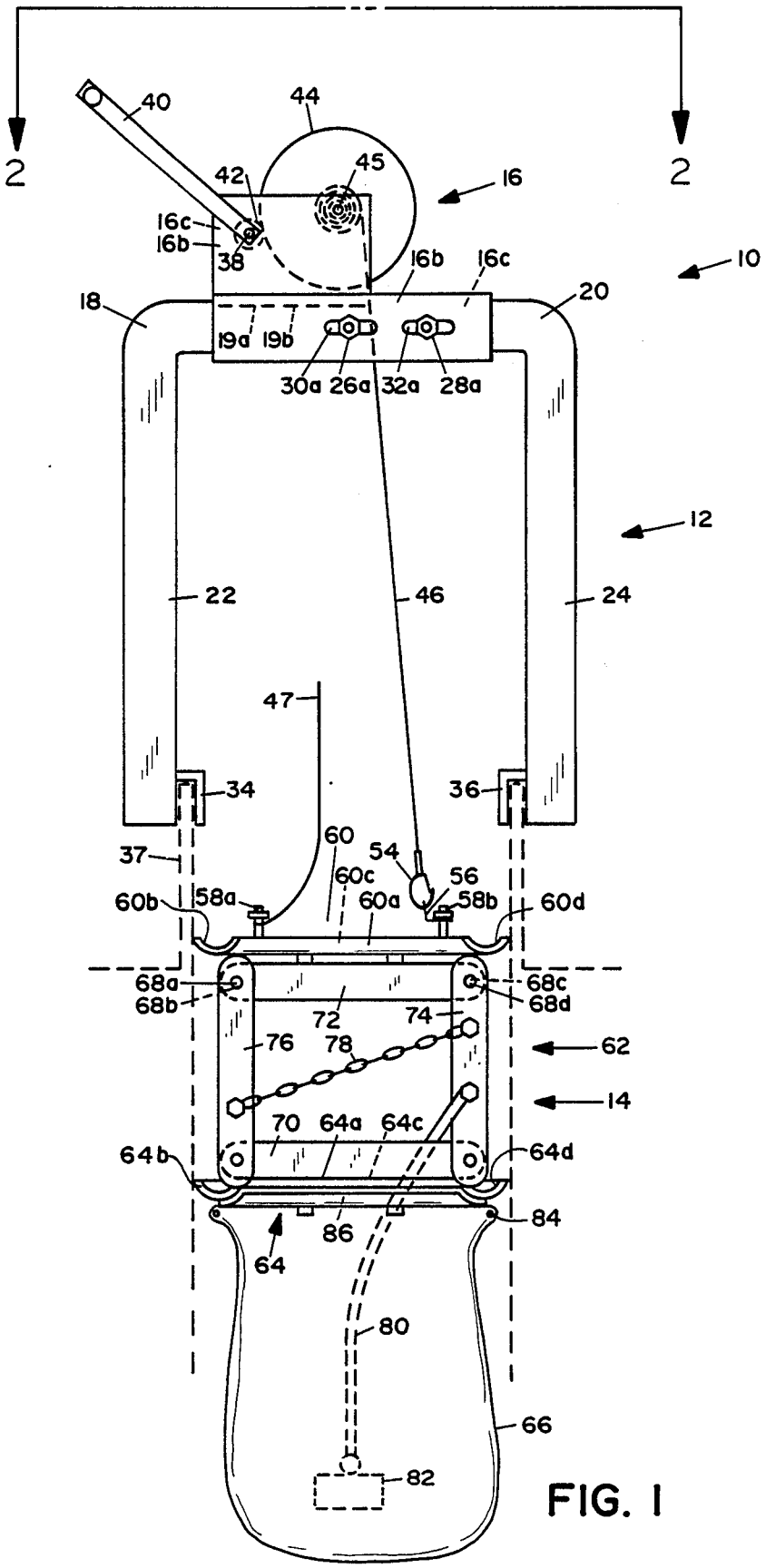
FIG. 1 illustrates a side view of a chimney sweeping system.
Figure 2:
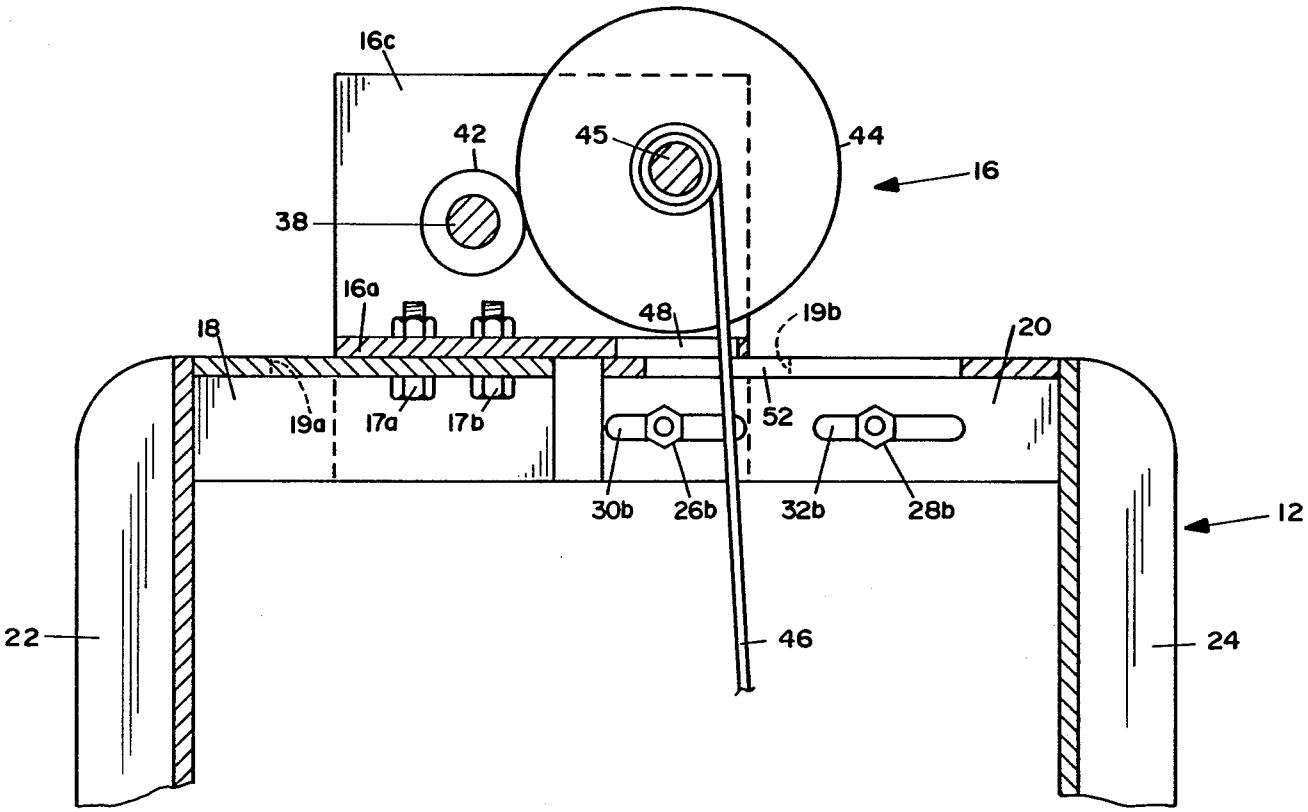
FIG. 2 illustrates a side view in cross section of the winch assembly.
Figure 3:
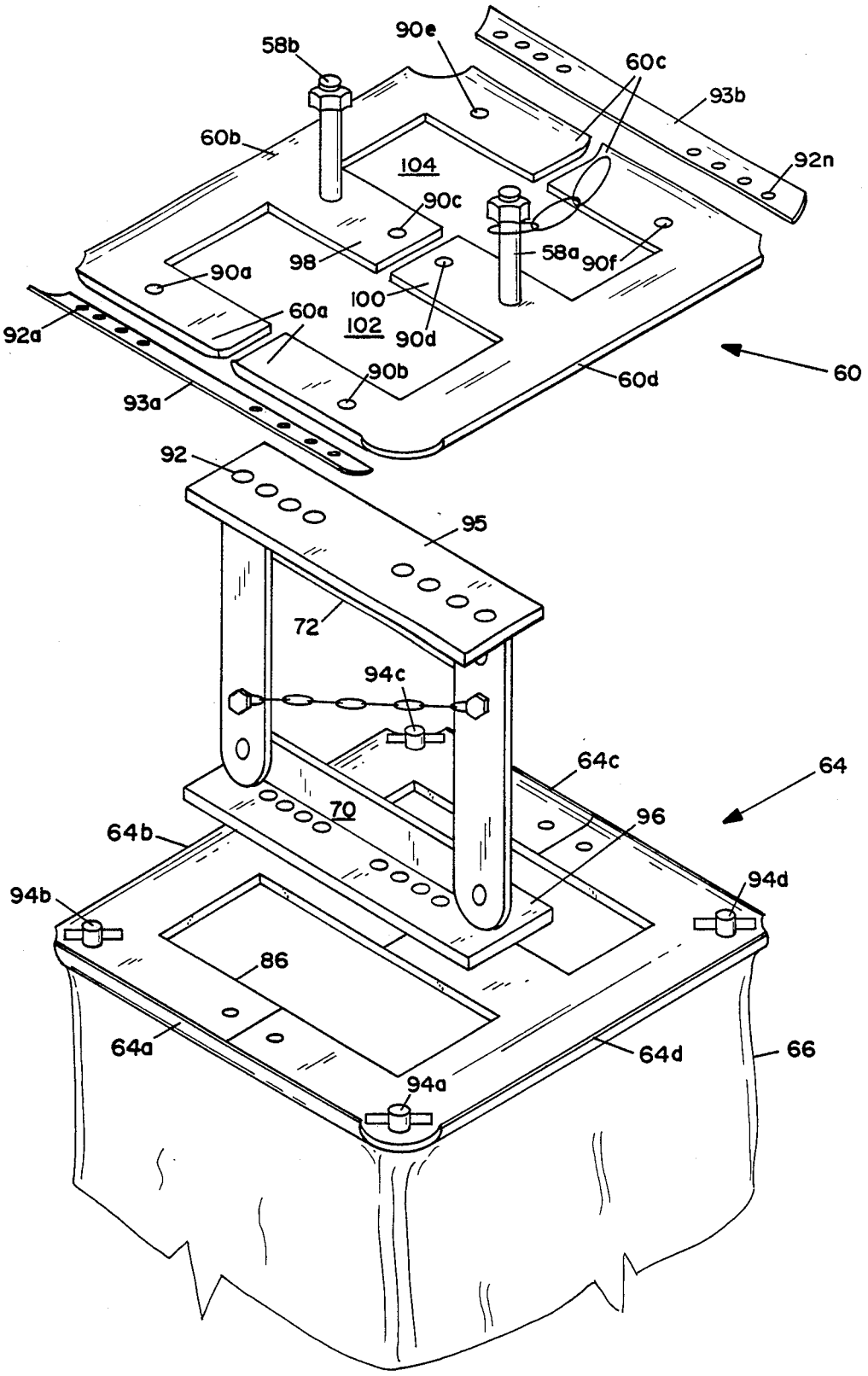
FIG. 3 illustrates an exploded perspective view of a scraper assembly.

FIGS. 1-3 illustrate a chimney sweep system 10, the present invention, including a chimney support assembly 12, a scraper assembly 14, and a winch assembly 16 mounted on the chimney support assembly 12 which carries scraper assembly 14.

FIG. 1 illustrates a side view of the chimney support assembly 12 including laterally adjustable horizontal channeled support arms 18 and 20 for the attachment of the winch assembly 16, including a winch assembly top plate **16*a*, shown in FIG. 2, and side plates 16*b* and 16*c* fitted and slide adjustable over and along support arms 18 and 20. Vertical support arms 22 and 24 attach to support arms 18 and 20 as illustrated. The horizontal support arms include support adjusting bolts 26*a*–26*b* and 28*a*–28*b* extending through adjusting slots 30*a*–30*b* and 32*a*–32*b* respectively, thereby allowing horizontal adjustments between support arms 22 and 24 to accommodate different chimney widths. Right angle flanges 34 and 36 downwardly extend from the lower inner sides of the vertical support arms 22 and 24 for fastening the chimney support assembly 12 to the top orifice of a chimney or chimney flue 37** shown in dashed lines.

A winch assembly 16 lowers and raises the scraper assembly 14 within the chimney 37. A drive shaft 38 rotates by a handle 40 or by another suitable power drive mechanism. A smaller drive shaft gear 42 meshes directly with a larger winch gear 44 mounted on shaft drum 45, thereby providing a mechanical ratio for winding and unwinding a suspension cable 46. The suspension cable 46 passes through an access hole 48 in the bottom of the winch frame **16*a* and through an elongated access slot 52 in the horizontal support arm 20 as illustrated in FIG. 2. The slot 52 runs a majority of the length of the right hand portion of the arm 20 for adjustability such as $4\frac{1}{2}$ inches by $\frac{1}{4}''$ by way of example and for illustration. A suspension hook 54 connects the suspension cable 46 with the scraper assembly 14**.

The scraper assembly 14 includes a suspension chain 56, suspension bolts 58*a*–58*b*, and upper rectangular scraper 60 including upwardly turned edges 60*a*–60*d*, a flexing parallelogram 62, a lower scraper 64 including upward turned edges 64*a*–64*d*, an elasticized collection bag 66, and is now described in detail.

During the descent of the scraper assembly 14, the flexing parallelogram assembly 62 assumes a plurality of configurations provided by swivel bushings 68*a*–68*d* connecting horizontal arms 70 and 72 with the vertical arms 74 and 76, thereby facilitating the descent of the scraper 14 into a chimney orifice. A limit chain 78 connects the vertical arms 74 and 76, providing parallel alignment of the upper scraper 60 with the lower scraper 64 as the scraper assembly 14 is raised.

A weight cable 80 connected to vertical arm 74 of the flexing parallelogram assembly 62 secures a weight 82 attached thereto. The weight cable 80 and attached weight 82, extend into the elasticized collection bag 66, thereby maintaining proper orientation of the elasticized collection bag 66 below the lower scraper 64 during both descent and subsequent ascent of the scraper assembly 14. Elastic 84 extends within and along the top perimeter of the collection bag 66, and maintains the open top of the collection bag 66 within close proximity of the inner edge 86 of the lower scraper 64 at all points of adjustment of the lower scraper 64.

FIG. 2 illustrates a side view in cross-section of the winch assembly 12 taken along line 2—2 of FIG. 1 where all numerals correspond to those already described. Winch assembly plates 16*a*–16*c* position over and along channeled support arms 18 and 20. The winch 16 assembly secures to support arm 18 with bolts and nut assemblies 17*a*–17*b*. Elongated holes 19*a* and 19*b* similar to the hole 52 provides for adjustability of the winch and the holes are $4'' \times \frac{3}{8}'$ by way of example and for illustration. Horizontal support arm 20, and consequentially vertical support arm 24, is adjustable beneath and within winch assembly plates 16*a*–16*c*. Nut and bolt assemblies 26*a*–26*b*, 28*a*–28*b* in slots 30*a*–30*b* and 32*a*–32*b* lock in lateral adjustment between support arms 22 and 24 when secured to allow for a proper fit of the chimney support assembly 12 over and above chimney orifice. Suspension cable 46 passes through slotted holes 48 and 52 which are sufficient in length to allow for free cable passage downwardly at extreme inner or outer adjustment of support arm 20 within the winch assembly 16*a*–16*c* slots 30*a*–30*b* and 32*a*–32*b*.

FIG. 3 illustrates an exploded view of the scraper 60 where all numerals correspond to those already described including upwardly concaved edges 60*a*–60*d* for an improved scrapping action. Bars 60*a* and 60*c* are segmented for adjustment of sections 60*b* and 60*d* laterally. Center members 98 and 100 in scraper assembly 60 fasten the scraper assembly 60 to a support bar 95. A plurality of scraper adjustment bolts 90*a*–90*f* and scraper adjustment holes 92*a*–92*n* in curved adjustment member supports 93*a*–93*b* and support bar 95, positioned perpendicular to horizontal parallelogram member 72, and provides for horizontal adjustment of the upper scraper 60 members for scraping chimneys of various inner diameters. Void areas 102 and 104 in scraper assembly 60 and similar, void areas in scraper 64 allow a path for creosote and soot to fall into elasticized bag 66. The lower scraper 64 similarly includes support bar 96, equivalent upwardly concaved edges, scraper adjustment bolts, and scraper adjustment holes which are not numbered or detailed, for the sake of brevity in the disclosure. Mounting wing nuts and bolts 94*a*–94*d* secure the elasticized collection bag 66 during operation of the invention and allows the collection bag to be removed for cleaning.

MODE OF OPERATION

FIG. 1 best illustrates the mode of operation of the chimney sweep system 10 along with FIGS. 2 and 3. The chimney support assembly 12 support arms 22 and 24 adjust horizontally for attachment to the uppermost portion of the chimney 37. The upper and lower scrapers, 60 and 64, respectively, horizontally adjust to accommodate the inner flue size and/or the amount of substance which has collected on the inner surface of the chimney. Another cable 47 attaches to bolt member 58*a* to allow the scraper assembly 14 to collapse for descent into the chimney. Once the bottom of the chimney is reached, the scraper assembly 14 raises by opposite rotation of the drive shaft 38 and cable 46 is tightened and pulls upwardly on bolt 58*b* causing the parallelogram assembly 62 to become erected for subsequent passage of the scraper assembly 14 up the chimney for purposes of chimney cleaning. Scraper size can be adjusted outwardly as the cleaning progresses. The upwardly concaved edges of the scraper 60 and 64 scrape the inner sides of the flue while the elasticized collection bag retains the scraped creosote and dust.

ALTERNATIVE EMBODIMENT

Figure 4:
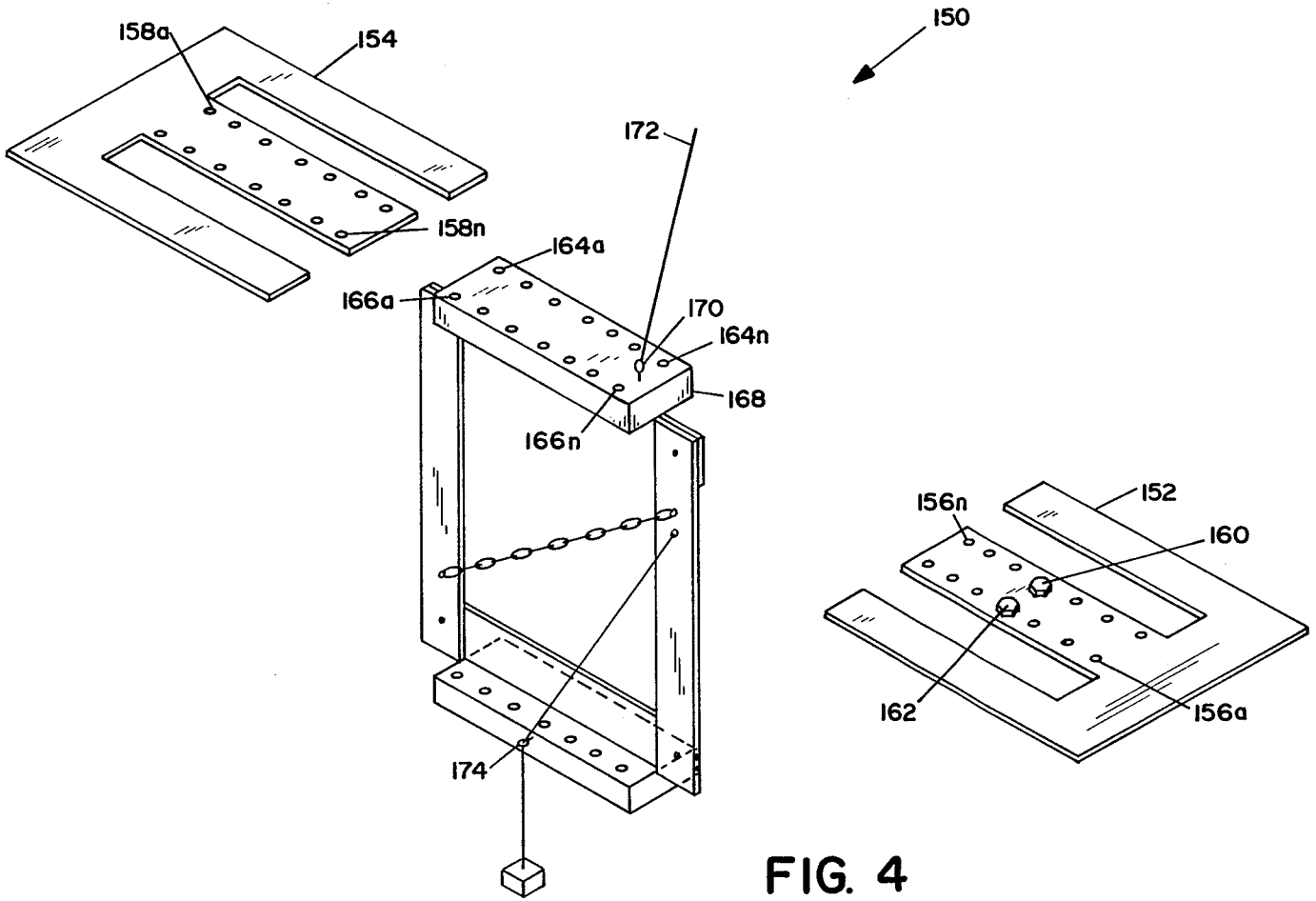
FIG. 4 illustrates an alternative embodiment of an adjustable scrapper.

FIG. 4 illustrates a perspective view of a top or bottom scraper assembly 150 including a right side 152 and a left side 154. The right and left sides include a plurality of holes 156*a*–156*n* and 158*a*–158*n* accordingly. Nut and bolt assembly 160 and 162 engage through holes 164*a*–164*n* and 166*a*–166*n* in member 168 to secure the right hand side 152 to the left hand side 154. The bottom scraper assembly while not shown is like the top scraper assembly. An eye bolt 170 secures a cable 172. An eye bolt 174 provides for securing of the weight cable. All other elements correspond to those elements as previously described. The bottom scraper assembly of course corresponds to the top scraper assembly. Likewise, the width of the arms could also be provided with the same type of adjustability with respect to providing like holes in each of the members, for overlapping of the members. This will provide the necessary adjustability as required for the scraper assemblies.

The chimney sweep system and method of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A chimney sweep system comprising:

a. a chimney support assembly including two right angle vertical arms, two horizontal channeled support arms, two vertical right angle flanges extending downwardly from the lower inner sides of the vertical support arms, two side plates fitted over opposite outer sides of the horizontal channeled support arms, and a slotted hole through one horizontal support arm through which passes a suspension chain;

b. a winch including a horizontal assembly plate, two vertical top assembly plates connected perpendicularly to the horizontal assembly plate, a slotted hole in the horizontal assembly plate allowing downward passage of the suspension cable, a drive shaft which rotates by a handle or other suitable power drive mechanism, a smaller drive shaft gear meshing with a larger winch gear mounted on a shaft drum thereby providing a mechanical ratio for winding and unwinding the suspension cable;

c. upper and lower solid scrapers each including four upwardly concaved edges, two rectangular void areas defined by two outer segmented bars and by two center members, two curved adjustment member supports fastened to the lower sides of the segmented bars, and a support bar positioned perpendicular to a flexing parallelogram for attachment to said parallelogram;

d. a flexing parallelogram including two horizontal arms connected by swivel bushings on each end to two vertical arms, a limit chain attached to the vertical arms, and a weight cable with a weight attached thereto connected to one vertical arm, said weight cable extending through one void area of the lower scraper; and, e. a collection bag with its four corners attached to corresponding corners of the lower scraper, said collection bag including elastic extending through and along its uppermost perimeter.

* * * * *